United States Patent [19]
Winger
[11] 4,317,554
[45] Mar. 2, 1982

[54] WREATH HANGER

[75] Inventor: Timothy M. Winger, Lancaster, Pa.

[73] Assignee: Novelty Manufacturing Company, Lancaster, Pa.

[21] Appl. No.: 128,910

[22] Filed: Mar. 10, 1980

[51] Int. Cl.[3] ..... A47G 7/00
[52] U.S. Cl. ..... 248/205 A
[58] Field of Search ..... 248/205 A, 467, 316 D, 248/27.8

[56] References Cited

U.S. PATENT DOCUMENTS

| | | | |
|---|---|---|---|
| 1,907,918 | 5/1933 | White | 248/27.8 |
| 2,081,095 | 5/1937 | Mull | 248/205 A |
| 2,122,999 | 7/1938 | Burke | 248/205 A X |
| 2,765,998 | 10/1956 | Engert | 248/205 A X |
| 3,079,117 | 2/1963 | Margulis | 248/205 A X |
| 3,409,257 | 11/1968 | Elm | 248/205 A X |
| 3,458,946 | 8/1969 | Lasswell | 248/205 A X |
| 3,713,614 | 1/1973 | Taylor | 248/205 A |
| 3,900,059 | 8/1975 | Kirk et al. | 248/205 A X |
| 4,040,522 | 8/1977 | Vickery | 248/205 A X |

FOREIGN PATENT DOCUMENTS

| | | | |
|---|---|---|---|
| 228603 | 6/1960 | Australia | 248/205 A |
| 2658871 | 7/1977 | Fed. Rep. of Germany | 248/205 A |
| 408315 | 9/1966 | Switzerland | 248/205 A |
| 1309950 | 3/1973 | United Kingdom | 248/205 A |

*Primary Examiner*—Thomas F. Callaghan
*Attorney, Agent, or Firm*—Martin Fruitman

[57] ABSTRACT

A simple sheet metal hanger for attaching wreaths and decorative sprays to tombstones and other similar monuments. A weather resistant adhesive is pre-coated upon a flat base and used to attach the base to a vertical surface. An approximately horizontal section of the hanger and an angular narrow spindle-like section extended from the base. The narrow vertical section is used to pierce the foam support of the decorative item and is then bent over toward the hanger base to lock the decoration in place.

3 Claims, 2 Drawing Figures

WREATH HANGER

BACKGROUND OF THE INVENTION

The present invention relates generally to supports and hangers, and more specifically to a support means for holding a wreath or spray on a monument.

The restriction against decorations and flowers being placed on the ground at cemeteries is now so common that numerous devices are available to attach wreaths and decorations to tombstones. These prior art devices have tended to be either partially built into the tombstone, for instance a plate slipped between the monument base and the vertical stone, or clamp-around devices.

These devices which clamp around the stone are invariably complex and costly, because they must in some way be adjustable to various widths or thicknesses of stones. Furthermore, their cost has led to the added complication of attempting to make them theft-proof, and such a goal has frequently required special installation tools.

Finally, a consistent problem with all the existing devices is that they are so large and cumbersome that they cannot be installed in a way that the decoration itself will cover them up and they, therefore, tend to be made decorative, of themselves, and thus add to the cost.

It is therefore the object of this invention to furnish a simple, inexpensive hanger to hold wreaths and decorations onto a tombstone.

It is a further object to yield a hanger which requires no special installation tools or skills.

It is also an object to furnish a hanger which is small enough to be virtually unseen when covered by a wreath or other decoration.

SUMMARY OF THE INVENTION

These objectives are all attained by the design of the present invention which is a simple one-piece hanger cut from a thin piece of sheet metal.

The hanger is formed into a configuration similar to a conventional hook by forming three distinct sections. The hook, however, is made of ductile sheet metal and has very little rigidity. The outermost spindle section, which is narrowed almost to a point, can easily be bent by using the fingers.

In the preferred embodiment the base section of the hanger is a simple rectangle of sheet metal about the size of a business card. One surface of the base section is pre-coated with a pressure sensitive, weather resistant adhesive. The bridge section of the hanger projects away from the uncoated surface of the base section at approximately a right angle, and narrows considerably as it progresses away from the base section.

The spindle section of the hanger projects away from the bridge section at approximately a 45 degree angle in the same general direction as the base section, forming an angle of less than 90 degrees with the base section, so that the cross section of the hanger forms a distorted "U" configuration. The spindle section also narrows in width as it moves away from the bridge section, so that at the end of the spindle section the hanger is quite narrow and has little strength in the direction transverse to the plane of the sheet.

The hanger is used by simply positioning it with the bridge section down and pressing the adhesive against any clean, dry, semismooth surface of the monument.

The spindle section is then pierced through the foam base of the wreath or through any other decorative item, until the end protrudes through the decoration, and the protruding end is bent over with the fingers to lock the decoration in place.

The simple mode of attachment permits the hanger to be used on any monument, regardless of size or shape, and while a vertical surface is almost always available, the invention is not restricted to such an orientation. Moreover, the ductile material permits reshaping and reuse many times.

However, the greatest benefit is the inexpensive and simple construction, which makes it likely that a new hanger will be available for use with each new decoration.

DETAILED DESCRIPTION OF THE INVENTION

Figure 1:
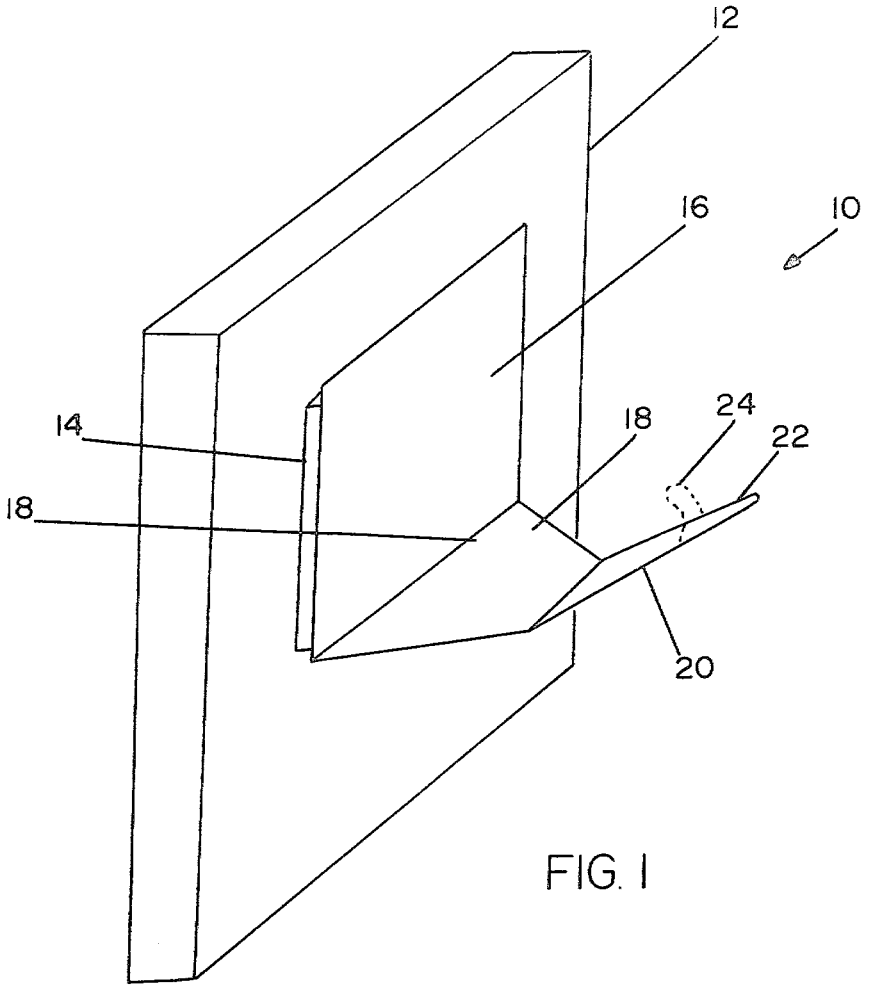
FIG. 1 is a persepctive view of the preferred embodiment of the invention shown attached to a vertical surface.

FIG. 1 shows the preferred embodiment of the invention as it would look in use attached to a vertical surface, where hanger 10 is attached to monument 12 by pressure sensitive adhesive 14.

Base section 16 is a sheet of metal upon which adhesive 14 is pre-coated. In typical use, hanger 10 is attached to monument 12 with bridge section 18 at the lower end of base section 16. Hanger 10 is bent so that bridge section 18 meets base section 16 with approximately a right angle between their two planes.

In the preferred embodiment, bridge section 18 narrows considerably over its length in order to meet spindle section 20 with a considerably narrower width.

Spindle section 20 meets bridge section 18 at approximately a 45 degree angle and is oriented so that its point 22 aims in the general direction of the open end of base section 16. Spindle section 20 narrows down as it approaches point 22 in order to make penetration of point 22 into a decoration (not shown) easier.

With hanger 10 attached to a monument, the decoration is hung upon it by penetrating point 22 into and through the decoration, and using the ductile nature of spindle section 20 and its lack of rigidity in the direction transverse to the plane of the sheet metal, to permit easily bending point 22 into the configuration of tab 24. This simple process locks the decoration onto hanger 10, preventing wind or accidental contact from dislodging it.

Figure 2:
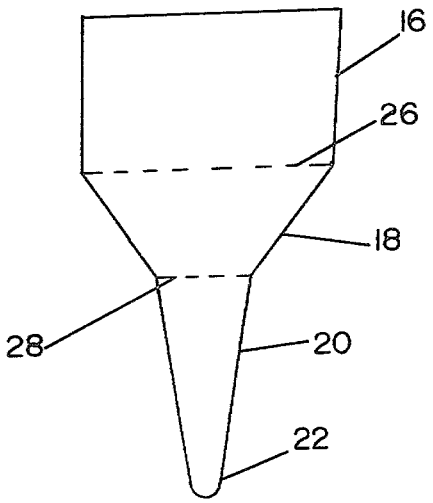
FIG. 2 is a sheet metal layout pattern of the preferred embodiment.

FIG. 2 shows the sheet metal layout pattern of the hanger of the preferred embodiment. For this particular design, base section 16 is a rectangle with a width of approximately $3\frac{1}{4}$ inches and a length of approximately $2\frac{1}{4}$ inches. The length of the pattern from end to end is approximately 6 inches, and point 22 narrows down to approximately one-quarter of an inch, while fold line 28 is approximately one inch long. With such a configuration, made from 0.032 inch thick aluminum sheet, the area of base section 16 is large enough to support a typical wreath or spray with conventional pressure sensitive adhesive foam used for attachment to the monument, and point 22 is both strong enough to penetrate the wreath, but ductile enough in the direction perpendicular to its surface to permit easy bending of locking tab 24.

The manufacture of hanger 10 involves essentially only the process of stamping the pattern of FIG. 2, bending base section 16 and spindle section 20 toward the same direction, then coating the outside surface of base section 16 with adhesive. Clearly, the low cost of such a procedure eliminates any concern about theft of the hanger, and makes it virtually disposable.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, bridge section 18 need not have angular sides and the reduction in width between base section 16 and spindle section 20 could occur in one or more step functions rather than in a smooth transition.

What is claimed as new and desired to be secured by Letters Patent of the United States is:

1. A hanger for attachment of wreaths and sprays to monuments and tombstones comprising:

a flat sheet metal base section with one surface coated with adhesive; and a second sheet metal section integral with and projecting away from the entire width of the base section and narrowing to a point, said second sheet metal section is itself bent to form two distinct sections, a bridge section and an outermost spindle section, angularly oriented to each other and the base section, so that the plane of the spindle section is oriented relative to said base section at an angle of less than 90 degrees, said spindle section being of such length, width and thickness that it can pierce a decoration, protrude through it, and, after penetrating the decoration, be bent back upon itself to lock the decoration onto the spindle section.

2. A hanger as in claim 1 wherein the second section is of a width, thickness and ductility to permit the point to be bent back upon itself by only a user's fingers.

3. A hanger as in claim 1 wherein the bridge section is oriented at an angle of approximately 90 degrees with the base section, and the spindle section is oriented at an angle of approximately 45 degrees with the bridge section.

* * * * *